United States Patent [19]

Marforio

[11] 3,994,248

[45] Nov. 30, 1976

[54] TOP ROLLER-CARRIAGE FOR SEWING MACHINES

[75] Inventor: Nerino Marforio, Milan, Italy

[73] Assignee: Rockwell-Rimoldi S.p.A., Milan, Italy

[22] Filed: Aug. 4, 1975

[21] Appl. No.: 601,272

[30] Foreign Application Priority Data

Aug. 7, 1974 Italy ..... 26073/74

[52] U.S. Cl. ..... 112/214

[51] Int. Cl.[2] ..... D05B 27/10

[58] Field of Search ..... 112/214, 203, 211

[56] References Cited

UNITED STATES PATENTS

| | | | |
|---|---|---|---|
| 1,259,996 | 3/1918 | Kinder | 112/203 |
| 2,461,862 | 2/1949 | Weis | 112/214 |
| 3,285,211 | 11/1966 | Hayes et al. | 112/214 |
| 3,435,790 | 4/1969 | Hale | 112/214 |
| 3,625,168 | 12/1971 | Palazzo | 112/211 |

FOREIGN PATENTS OR APPLICATIONS

| | | | |
|---|---|---|---|
| 581,187 | 7/1933 | Germany | 112/214 |

*Primary Examiner*—Werner H. Schroeder
*Assistant Examiner*—Moshe I. Cohen

[57] ABSTRACT

An improved top roller-carriage for use on sewing machines having a bottom roller and on which superimposed layers of material are to be joined, the roller-carriage including an elongated torque transmitting shaft connected through intermediate mechanisms to the main drive and including means for mounting the torque shaft on the machine in such a way that it can be pivoted about both a horizontal and a vertical axis so that the roller while it is connected on one end of the torque shaft can be completely removed from its operative position adjacent the machine needle and can adjust vertically to accommodate different material thicknesses.

6 Claims, 6 Drawing Figures

TOP ROLLER-CARRIAGE FOR SEWING MACHINES

BACKGROUND OF THE INVENTION

The subject of this invention is a top roller-carriage placed in front of the needle and matching the usual bottom carriage in a sewing machine.

Sewing machines, usually equipped with a bottom jaw-carriage, can be equipped also with a top jaw-carriage or roller-carriage, particularly if these machines are intended to assemble superimposed work layers with matched edges.

The top carriage-roller is set in action with a unidirectional intermittent motion by means which change the rotary motion of the main shaft into the intermittent motion synchronous with the carriage movement of the bottom jaw.

We have found that, to get perfect synchronism in advancing two layers of work to be sewn together and to forestall moments when one layer rotates and the other does not, the top carriage-roller must function ahead of the needle and press on the needle plate in the zone between the two parts of the jaw. For this purpose the same applicant has invented a top carriage in which the roller is positioned in front of the needle and the kinematic motion giving the roller a unidirectional intermittent movement that includes: the means which change and transfer the rotary movement of the main shaft of the machine into a unidirectional intermittent movement derived from a shaft positioned in back of the machine behind the sewing mechanisms; a first belt transmission supported by an arm perpendicular to the carriage and in back of the machine, a second belt transmission supported by an arm that transfers the intermittent movement from the back part to the front part of the machine and that is set above the sewing mechanisms; a third belt transmission that transfers the intermittent movement to the roller placed in front of the needle.

The second and third belt transmissions that completely cover the needle and the zone of the pressure foot, can rotate simultaneously around a horizontal axis in a vertical plane, so the conveyor roller can adapt itself to thickness changes.

We have found that the carriage briefly referred to before is a considerable encumbrance in the sewing zone; therefore, the use of this machine by an operator who must guide the work with her hands, as close as possible to the sewing mechanisms, is quite infeasible. In fact, machines having the above-mentioned carriage are used only in automatic units of work.

We have noticed the added inconvenience that, with a change in thickness of the work layer, the roller rises rotating in a vertical plane and withdraws from the sewing zone, so the operator is no longer in the ideal zone as close as possible to the needle.

SUMMARY OF THE INVENTION

Accordingly, the main object of this invention is to provide a top carriage with a roller operating in front of the needle that presents the least encumbrance to the operator in the sewing zone and one that can even be readily moved from the zone for control and inspection of the sewing mechanisms.

A further object of this invention is to provide a top carriage in which the conveyor roller does not alter its position in relation to the sewing mechanisms, particularly in relation to the needle and to the top jaw-carriage.

An additional object of this invention is to provide a top roller-carriage in which the roller is splined to a shaft that can rotate in a horizontal plane around a vertical axis and in a vertical plane around a horizontal axis perpendicular to the vertical axis.

This feature and other features of this invention will be pointed out in fuller detail in the following description according to a preferred, but not exclusive embodiment given merely as an example and not restrictively in the attached drawings.

DESCRIPTION OF THE INVENTION

Figure 1:
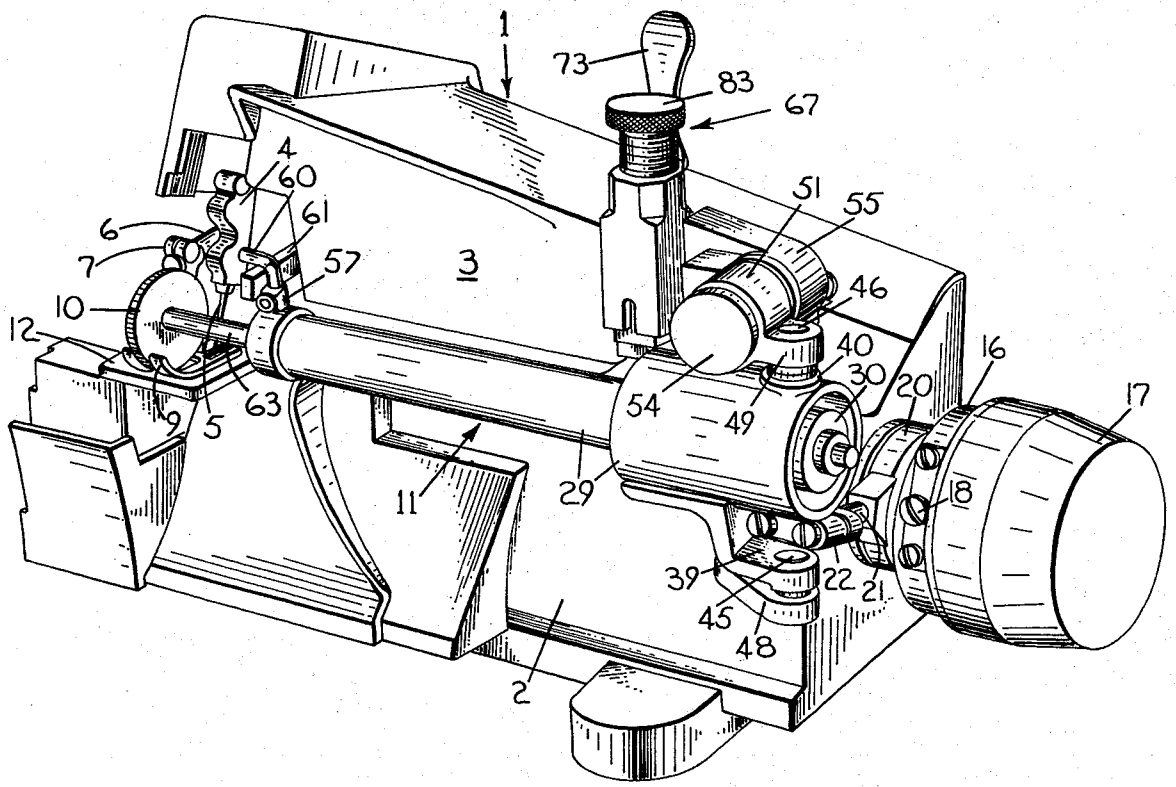
FIG. 1 shows in perspective a cut-sew sewing machine with the top roller-carriage in working position.
Figure 2:
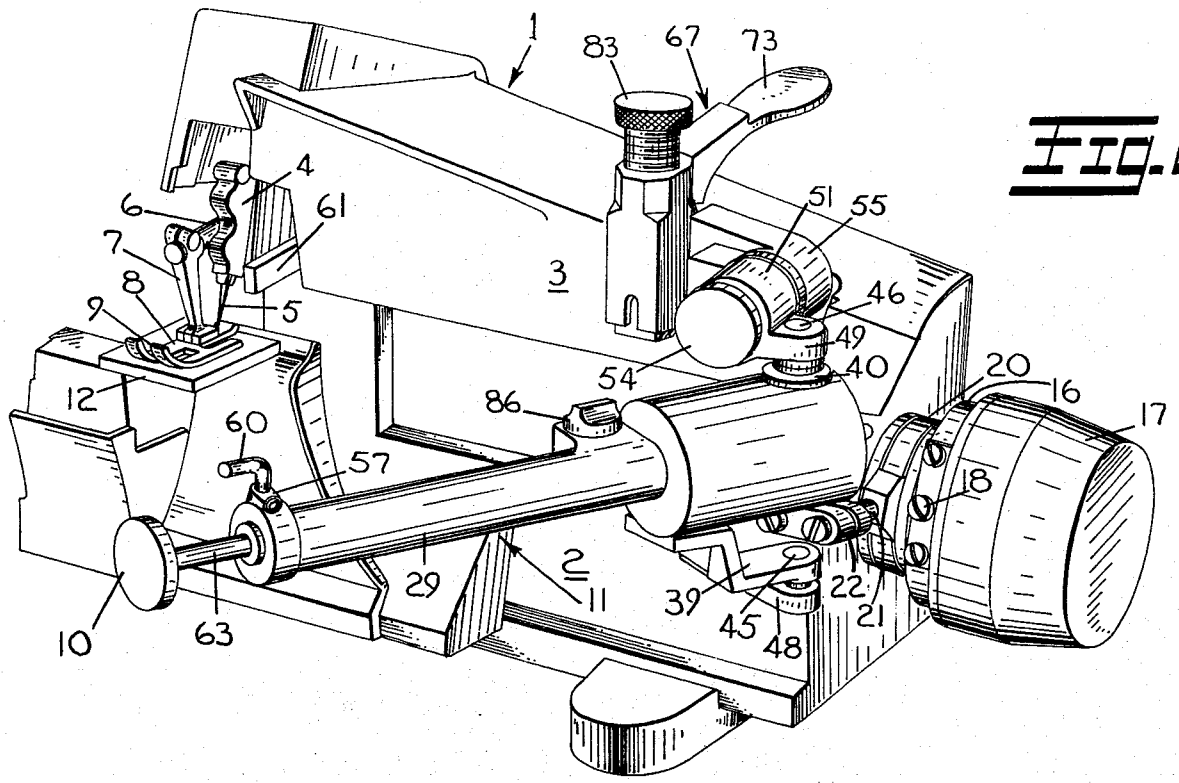
FIG. 2 shows in perspective the same machine as in FIG. 1 with the top roller-carriage out of the way of the sewing mechanisms in non-working position.

With reference to FIGS. 1 and 2, FIG. 1 shows in detail a cut-sew sewing machine consisting of a base 2 and an arm 3 at the end of which are the usual needle bar 4 bearing a needle 5 and a presser bar 6 having a pressure foot 7 (FIG. 2) whose sole 8 has a cleft 9 within which is located a roller 10 of the top carriage 11.

The mechanisms which work together to form the stitch that are placed under the usual needle plate 12, i.e., the jaw with two or more parts and one or more crochet hooks, have not been shown since they are of the type usually used in well-known technology.

Figure 3:
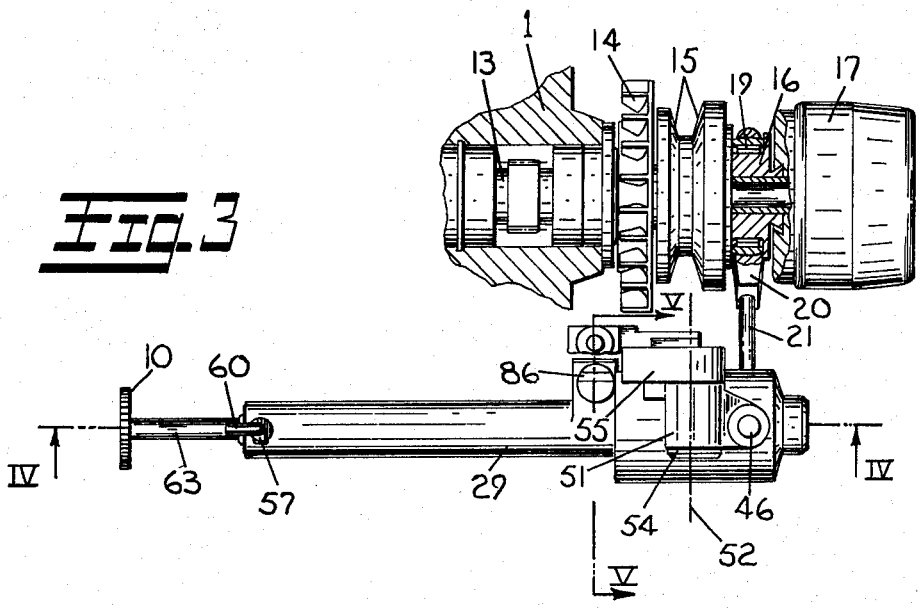
FIG. 3 shows a plan view of the top roller-carriage.

In the base 2 of the machine is housed, among other things, a main shaft 13 (FIG. 3) on whose outside part, coming out of the base of the machine, are mounted a cooling fan 14, a sheave 15, a cam 16, having a changeable eccentricity, and a handwheel 17.

The big-end 20 of a connecting rod 21 is hinged, with the interposition of a roller bearing 19, onto the well-known cam 16, whose eccentricity can be changed by varying adjusting screws 18. The foot 22 of the big-end 20 has a sphere-headed hinge 23 (FIG. 4) integral with an outside sleeve 24 of unidirectional clutch 25. Clutch 25 further comprises an inside sleeve 26 mounted on an elongated torque transmitting shaft 27, rollers 28 (see FIG. 4) are inserted between the inside sleeve 26 and the outside sleeve 24.

Figure 4:
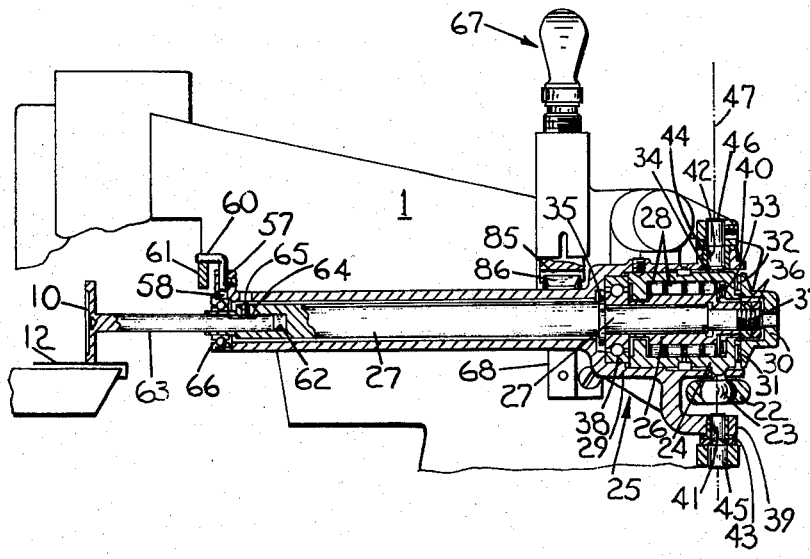
FIG. 4 shows a top roller-carriage in a front cutaway view according to straight line IV—IV of FIG. 3.

With reference to FIG. 4, the unidirectional clutch 25 is inserted in a tubular element 29 and held there by a ring nut 30 through the interposition of a first thrust block 31 inserted between the ring nut and a ledge 32 of the sleeve 24 and of a second thrust block 33 inserted between the ledge 32 and a ring 34, adhering to the inside of sleeve 26. The shaft 27 is blocked at the inside sleeve 26 between a ledge 35, machined on the shaft 27 itself and by a screw-nut/lock-nut system 36 screwed onto the threaded end 37, of the shaft 27. Shaft 27 is supported by, among other things, the tubular element 29 with the interposition of a ball bearing 38. The tubular element 29 has a bracket arm 39 and a projecting part 40 opposite the bracket arm 39. A through-hole 41 coaxial with another hole 42 machined in projecting part 40 is machined in bracket arm 39; bushings 43 and 44 are inserted in each of the holes 41 and 42; and pins 45 and 46 are inserted in the housings. These pins describe an axis of rotation 47 of the whole tubular element and, therefore, of the top carriage.

The rotation axis 47 passes through the center of spherical head 23.

Figure 6:
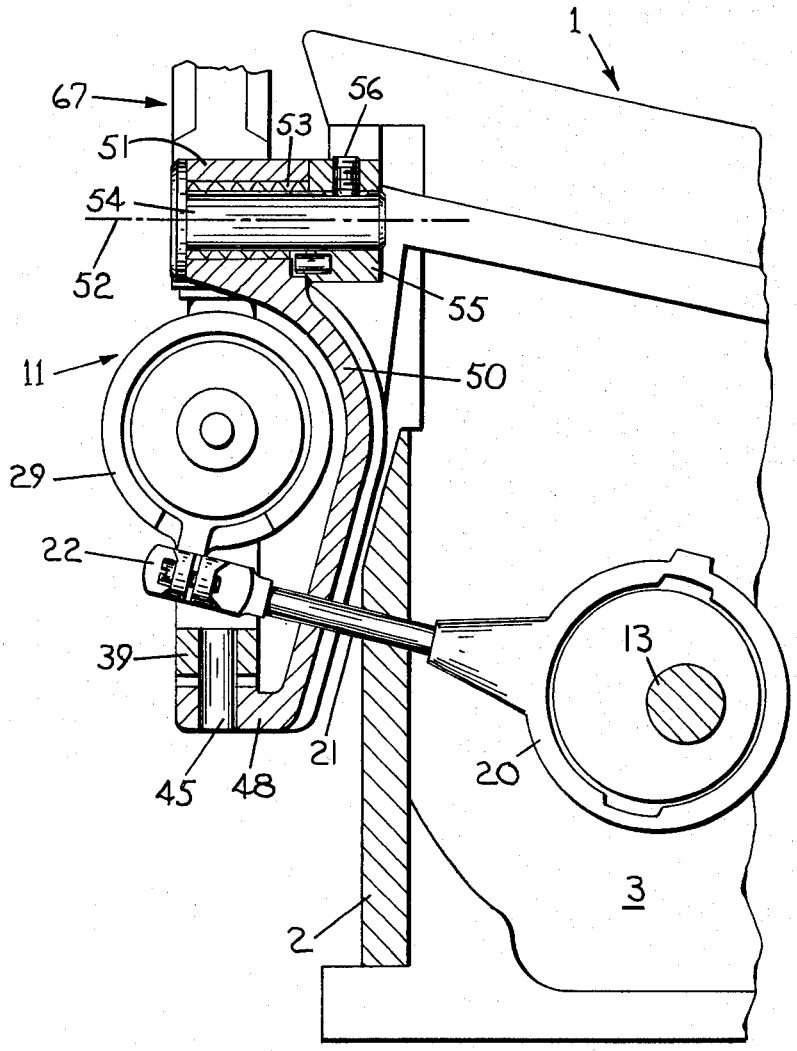
FIG. 6 shows the side view of the top carriage with sectionized parts to give a better view of other parts.

As better seen in FIG. 1, pins 45 and 46 are supported by the arms 48 and 49 of a fork 50, shown in FIG. 6, which matches up with the arm 49 and is also equipped with a yoke 51 having an axis 52 horizontal and perpendicular to axis 47.

The yoke 51 is mounted in operative position, with the interposition of a bushing 53, onto a pin 54, around which it rotates. This pin 54 is inserted in a ring-like support 55 which is integral with arm 3 of the machine.

Pin 54 is secured to the ring-like support 55 by a set screw 56. The fork 50 and, therefore, the whole top carriage 11, can rotate around the axis 52 horizontal and parallel to the sewing axis, or direction of travel of the pieces being joined.

The tubular element 29 extends towards the machine needle, surrounding shaft 27, until it comes close to the sewing mechanisms and at this outer end it has a projection 57 with a hole 58 in which is inserted and secured by a fastening screw 59 a bracket 60 which can be set above a lever 61 set in action by the same device (not shown) for raising the presser-foot of the machine so that, when the foot is raised, roller 10 is also raised from the work. Shaft 27 has at its end a hole 62 into which is inserted a shaft 63 bearing roller 10. Shaft 63 has a longitudinal slot 64 penetrated by a screw 65 passing also into shaft 27 so as to secure shaft 63 to shaft 27. Longitudinal slot 64 enables the regulating of the position of the roller with respect to the sewing mechanisms of the machine. Shaft 27 is supported at its end by a ball bearing 66 inserted between the shaft and the tubular element 29. Roller 10 of the top carriage 11 described above, therefore has intermediate mechanisms whereby power from the main shaft is translated into a unidirectional intermittent motion. These mechanisms comprise a connecting-rod cam system capable of changing the rotary motion of the shaft into an oscillating motion, and a unidirectional clutch capable of changing the oscillating motion into a unidirectional intermittent motion. The connecting-rod cam system and the unidirectional clutch are located near the handwheel away from the sewing mechanisms where only shaft 63 reaches bearing roller 10. This enables the operator to work quickly with her hands close to the sewing mechanisms to guide the work. The whole top carriage 11 can rotate in a horizontal plane around the vertical axis 47 and be moved away from the sewing mechanisms, as shown in FIG. 2, to facilitate any inspection and adjustment of the sewing mechanisms, for example, the threading of the needle.

The top carriage 11 can rotate also in a vertical plane around axis 52, so that roller 10 can change its distance from the needle plate depending on the thickness of the job.

A blocking and positioning device, identified as numeral 67, keeps the top carriage 11 in perfect position during sewing, by preventing it from rotating around axis 47.

Figure 5:
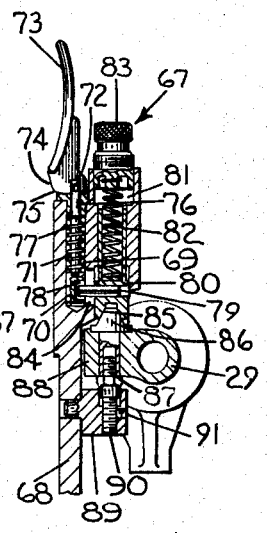
FIG. 5 shows the top roller-carriage in a cutaway side view according to line V—V of FIG. 3.

The blocking and positioning device 67, as shown in FIG. 5, is made up of a support 68 secured to the arm 3 of the machine. In the support 68 is a first hole 69 in which slides a small piston 70 carried by a rod 71. The end of rod 71 is pivotally connected at 72 to a small lever 73 having a surface 74 capable of sliding on the outside ledge 75 of a bushing 76 inserted in the hole 69.

A spring 77 is inserted around rod 71 between bushing 69 and small piston 70. Small piston 70 has a slot 78 into which penetrates a pin 79 perpendicularly to the axis of the small piston and integral with a latching block 80 that can slide inside a second hole 81 machined in support 78.

Block 80 is kept constantly pressed to the bottom by a spring 82 whose tension can be regulated by turning a screw 83 against which the spring 82 presses.

In support 68 there is a slot 84 in which pin 79 can travel. In block 80 a seat 85 is machined, which is capable of mating with wedge 86 that is secured by a screw 87 to a projecting part 88, of tubular element 29. Secured at the bottom part of support 68 is a locator 89 in which is inserted an adjusting screw 90 coaxial with screw 87 and adjustable to the position desired by means of set screw 91.

When spring 82 presses the seat 85 of block 80 against wedge 86, any rotation of tubular element 29 around axis 47 is prevented. However, the rotation of the tubular element in a vertical plane around axis 52 is not stopped, since pin 79 can travel upwardly inside slot 84 and slot 78 of the small piston 70; the rotation is resisted only by the spring, whose action must be overcome.

The roller can move also in a vertical plane to adapt itself to changes in the thickness of the job.

The adjusting screw 90 on which rests projecting part 88 of tubular element 29 obtains an initial setting of the distance of the roller from the needle plate. Therefore, screw 90 need only be lowered or raised from locator 89 to lower or raise the roller axis from the needle plate. To move the roller from its working zone, lever 73 need only be rotated to the bottom, causing surface 74 to slide on the outside ledge 75 of bushing 76 until it is brought to the balanced position shown in FIG. 2.

During the rotation of lever 73 small piston 70, after a free stroke, engages pin 79 and pulls it upward, which then makes block 80 rise, until seat 85 frees wedge 86.

At this point tubular element 29 and roller 10 are free to rotate in a horizontal plane around axis 47.

From the above description of a particular embodiment we see the achievement of the desired objective of obtaining a roller-carriage adaptable to changes in job thickness and movable from the sewing zone, with a minimum of encumbrance in the sewing zone, enabling the operator to maneuver her work and follow it as close as she can to the needle.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and claims.

I claim:

1. An improved top roller-carriage for sewing machines including a main shaft within a machine base in which the roller is operated in a unidirectional, intermittent manner by means of intermediate mechanisms deriving power from the machine main shaft, said roller-carriage comprising a roller for pressing the work-pieces at the sewing station, an elongated torque shaft supporting said roller and for transmitting power from the machine main shaft through the intermediate mechanisms to drive said roller, and means for mounting said torque transmitting shaft to the sewing machine, said mounting means providing for pivoting of said shaft and said roller about two axes extending substantially horizontally and vertically with respect to the base of the machine.

2. An improved roller-carriage as defined in claim 1 wherein said means mounting with said torque shaft to the sewing machine comprises a fork-like member that is mounted on the machine for pivoting about a horizontal axis, said fork-like member including means for mounting said torque shaft thereon for pivoting about a vertical axis.

3. An improved roller-carriage as defined in claim 2 wherein means are provided to prevent pivoting of said torque shaft about the axis.

4. An improved roller-carriage as defined in claim 3 wherein said means for preventing rotation of said torque shaft about the vertical axis comprises a spring biased latching block.

5. An improved roller-carriage as defined in claim 1 wherein means are included whereby said roller can be lifted from the workpiece when the machine presser-foot is raised.

6. An improved roller-carriage as defined in claim 5 wherein said lifting means comprises a bracket that is operatively connected to said torque shaft and operatively connected to the presser foot.

* * * * *